United States Patent [19]

Miura

[11] 4,313,982

[45] Feb. 2, 1982

[54] ADJUSTING METHOD AND APPARATUS FOR A CYLINDRICAL ARTICLE PERIPHERAL SURFACE COATING MACHINE

[75] Inventor: Hideo Miura, Kawasaki, Japan

[73] Assignee: Toyo Seikan Kaisha, Ltd., Tokyo, Japan

[21] Appl. No.: 107,233

[22] Filed: Dec. 26, 1979

[30] Foreign Application Priority Data

Jan. 30, 1979 [JP] Japan ..... 54-8673

[51] Int. Cl.[3] ..... B05D 1/28; B05C 1/08

[52] U.S. Cl. ..... 427/428; 118/681; 118/233; 118/262

[58] Field of Search ..... 118/46, 232, 233, 262, 118/680, 681, 670, 675; 101/38 A, 38 R, 39, 40, 350, 363; 427/428; 113/120 A

[56] References Cited

U.S. PATENT DOCUMENTS

| | | | |
|---|---|---|---|
| 2,749,878 | 6/1956 | Hagen | 118/262 X |
| 3,044,440 | 7/1962 | Molsberry et al. | 118/262 X |
| 3,616,778 | 11/1971 | Sirvet et al. | 118/262 |
| 3,855,967 | 12/1974 | Skrypek et al. | 101/40 X |

*Primary Examiner*—John P. McIntosh
*Assistant Examiner*—Bernard F. Plantz
*Attorney, Agent, or Firm*—Jordan and Hamburg

[57] ABSTRACT

Adjusting method and apparatus for a cylindrical article peripheral surface coating machine characterize in that a coating clearance between a coating roller and a cylindrical article fitted over each mandrel on a travelling mandrel conveyor, the coating clearance being formed for allowing the coating roller to be brought into rolling contact with the cylindrical article when the latter has entered the coating zone, a transfer clearance between the coating roller and a transfer roller formed for allowing the latter to be brought into rolling contact with the former, and a receiving clearance between the transfer roller and a fountain roller formed for allowing the latter to be brought into rolling contact with the former, are made adjustable each independently without affecting each other. In addition, for expanding the said coating clearance in the event the said mandrel should approach the coating zone without carrying thereon the said cylindrical article, the said coating roller, transfer roller and fountain roller are pivotally displaced on concentric arcs integrally and collectively without causing any change in the said transfer and receiving clearances. And the said transfer clearance is disposed lower than the line connecting the center of the coating roller with the center of the said collective pivotal displacement whereby the mandrel conveyor is prevented from being stained with a coating solution which scatter from the transfer clearance.

4 Claims, 14 Drawing Figures

ADJUSTING METHOD AND APPARATUS FOR A CYLINDRICAL ARTICLE PERIPHERAL SURFACE COATING MACHINE

This invention relates to an adjusting method for controllably forming a uniform coating film of desired thickness in a coating machine for coating the outer peripheral surface of cylindrical articles, especially two-piece metallic cans, and also to an apparatus to be used directly for execution of the said method.

As shown in FIG. 1, in a coating machine of this sort provided with a coating roller 20, a transfer roller 22 and a fountain roller 24, a receiving clearance C1 formed in the rolling contact between the fountain roller 24 and the transfer roller 22, a transfer clearance C2 formed in the rolling contact between the transfer roller 22 and the coating roller 20, and a coating clearance C3 formed in the rolling contact between the coating roller 20 and an outer peripheral surface of a metallic can, a, fitted over each mandrel 28 which is carried by a parallely advancing mandrel conveyor 26 and is passing through a coating zone, z, have heretofore been adjusted in such manners as disclosed in U.S. Pat. No. 3,616,778 and Japanese Patent Public Disclosure No. 26845/75 (U.S. Pat. No. 3,855,967) in which the receiving clearance C1, transfer clearance C2 and coating clearance C3 can be controlled and adjusted each independently before the coating operation. In those methods, however, in the event the mandrel 28 should approach the coating zone, z, without carrying thereon the metallic can, a, due to some trouble, it is necessary to enlarge the coating clearance C3 by letting the coating roller 20 go away from the mandrel 28 so as to disconnect the two from each other. However, in normal operation of the coating machine, the center 03 of the transfer roller 22 is placed on line L2 which passes through the center 02 of the coating roller 20 at right angles with line L1, the line L1 passing through the center 01 of the coating zone, z, and the center 02 of the coating roller 20. On the other hand, for expanding the coating clearance C3 the coating roller center 02 is retreated to a position 02' with a pivotal displacement center as the center which pivotal displacement center is decided near the center 03 with an accuracy within an approximately uninfluential range in practical use. However, even with such a pivotal displacement of the center 02 of the coating roller 20, it is necessary to place the center of the transfer roller 22 very close to the point 03 on line L2 so that the state of rolling contact between the coating roller 20 and the transfer roller 22 may not undergo a practical change. This results in the mechanism becoming more complicated and the maintenance, check and servicing more difficult. Even with an accuracy within a practically uninfluential range, the transfer clearance C2 undergoes a very small change because the coating roller 20 alone is subjected to a pivotal displacement, resulting in the amount of coating solution transferred becoming different. And when the coating roller 20 is returned to the original coating clearance C3, an error may occur with respect to the transfer clearance C2, which has a delicate influence on the thickness of the film formed on the outer peripheral surface of the metallic can, a, and thus impedes a uniform coating. Every time there occurs an error in the transfer clearance C2 it is required to adjust the transfer clearance C2 and to adjust the parallelism between the coating roller 20 and the transfer roller 22, which adjustments are very troublesome so lower the working efficiency of the machine.

Since the center 03 of the transfer roller 22 must occupy such a restricted position as mentioned above, the transfer clearance C2 is nearly positioned on line L2 and inevitably directs itself to the mandrel conveyor 26 so that, when the coating solution is transferred from the transfer roller 22 onto the coating roller 20, coating films F1 and F2 on the transfer roller 22 and coating roller 20 respectively are rolled in and pass through the transfer clearance C2 to form coating films F3 and F4 respectively while, in general, there is produced a droplet-shaped or atomized scatter of coating solution, which splashes and scatters toward the mandrel conveyor 26 as the transfer roller 22 and the coating roller 20 rotate at high speed, resulting in that the metallic cans, a, or mandrels 28 about to enter the coating zone, z, are thereby stained. In case the mandrels 28 have been stained, the inner peripheral surface of the metallic cans, a, fitted next time over the mandrel 28 is stained with the coating material adhered to the said mandrels 28 with the result that the so-stained cans are treated as defective articles, thus causing decrease in yield and increase in cost.

It is a primary object of this invention to provide an adjusting method and apparatus for a cylindrical article peripheral surface coating machine capable of forming at high speed a coating film of uniform thickness on the outer peripheral surface of a cylindrical article.

It is another object of this invention to provide an adjusting method and apparatus for a cylindrical article peripheral surface coating machine capable of preventing the inner peripheral surface of a cylindrical article from being stained with a coating solution while the machine is in operation.

It is still another object of this invention to provide an adjusting method and apparatus for a cylindrical article peripheral surface coating machine in which, if the receiving clearance, transfer clearance and coating clearance are pre-adjusted before the coating operation, both transfer roller and fountain roller can be pivotally displaced integrally with each other without causing any change in the receiving clearance and transfer clearance even in the event a mandrel carrying no cylindrical article thereon should approach the coating zone.

It is a further object of this invention to provide an adjusting apparatus for a cylindrical article peripheral surface coating machine in which a first bearing holder for the coating roller and a second bearing holder for the fountain roller are mounted on the same pivot shaft whereby said first and second bearing holders are made pivotally displaceable on concentric arcs.

It is a still further object of this invention to provide an adjusting method and apparatus for a cylindrical article peripheral surface coating machine in which the transfer clearance is positioned lower than the line joining the center of the coating roller and that of the pivot shaft whereby the mandrel conveyor can be prevented from being stained by the scatter of a coating solution from the transfer clearance.

It is an additional object of this invention to provide an adjusting apparatus for a cylindrical article peripheral surface coating machine in which the parallelism of the transfer roller with respect to the coating roller can be attained by adjusting and pivoting an eccentric bushing which pivots the second bearing holder to the pivot shaft.

It is another additional object of this invention to provide an adjusting apparatus for a cylindrical article peripheral surface coating machine in which the first and second bearing holders are connected together integrally by means of a connecting rod which constitutes part of a displacement control mechanism adapted to pivotally displace only the second bearing holder about the pivot shaft.

It is a further additional object of this invention to provide an adjusting apparatus for a cylindrical article peripheral surface coating machine in which a displacement control mechanism adapted to pivotally displace both the first and second bearing holder integrally with each other is connected to the aforesaid displacement control mechanism adapted to pivotally displace only the first bearing holder.

Other objects of this invention will become apparent by referring to this specification and the accompanying drawings, in which.

Figure 1:
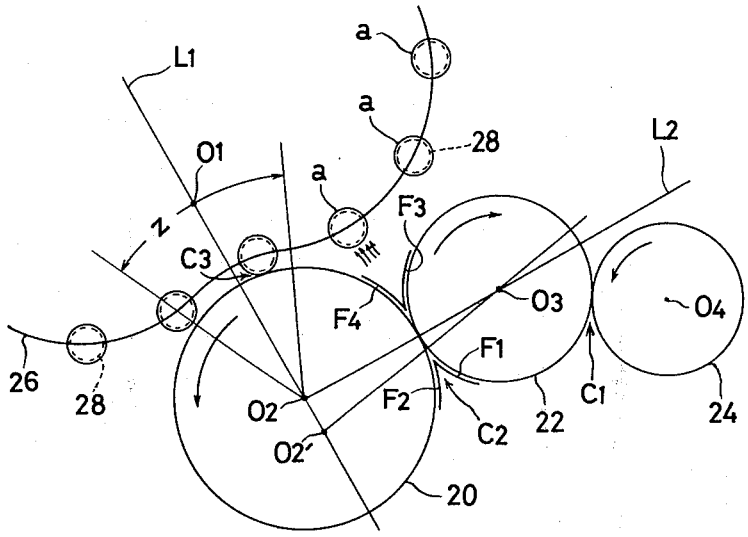
Fig.1 PRIOR ART
FIG. 1 illustrates a conventional apparatus of this sort.

In the adjusting method and apparatus for a cylindrical article peripheral surface coating machine according to this invention, a coating clearance between a coating roller and a cylindrical article fitted over each mandrel on a travelling mandrel conveyor, the coating clearance being formed for allowing the coating roller to be brought into rolling contact with the cylindrical article when the latter has entered the coating zone, a transfer clearance between the coating roller and a transfer roller formed for allowing the latter to be brought into rolling contact with the former, and a receiving clearance between the transfer roller and a fountain roller formed for allowing the latter to be brought into rolling contact with the former, are made adjustable each independently without affecting each other. In addition, for expanding the said coating clearance in the event the said mandrel should approach the coating zone without carrying thereon the said cylindrical article, the said coating roller, transfer roller and fountain roller are pivotally displaced on concentric arcs integrally and collectively without causing any change in the said transfer and receiving clearances. And the said transfer clearance is disposed lower than the line connecting the center of the coating roller with the center of the said collective pivotal displacement whereby the mandrel conveyor is prevented from being stained with a coating solution which scatter from the transfer clearance.

In this invention, to be more concrete, the coating roller, the fountain roller and the transfer roller are mounted rotatably on a first bearing holder and a second bearing holder, respectively, the first and the second bearing holder being coaxially mounted idlably for each independent pivotal displacement on a pivot shaft which extends horizontally through a stand frame with the second bearing holder mounted on the said pivot shaft through an eccentric bushing to make the transfer roller adjustable in parallelism with respect to the coating roller, and the transfer clearance between the coating roller and the transfer roller is positioned lower than the line joining the center of the coating roller and that of the aforesaid pivot shaft, while on the other hand a fountain roller shaft with the fountain roller secured to one end thereof is journaled through the second bearing holder via an eccentric sleeve and an eccentric bushing to make the fountain roller adjustable in parallelism and in rolling contact pressure with respect to the transfer roller, further the first and the second bearing holder are connected together through a connecting screw rod which constitutes part of a second displacement control mechanism, and an independent pivotal displacement of the first bearing holder is adjusted by a first displacement control mechanism which is connected to an end of the first bearing holder, an independent pivotal displacement of the second bearing holder is adjusted by the aforesaid second displacement control mechanism attached to one side of the second bearing holder, a rolling displacement of the aforesaid eccentric sleeve which bears therethrough the fountain roller shaft is adjusted by a third displacement control mechanism connected to the eccentric sleeve, and an integral pivotal displacement of the first and the second bearing holder is adjusted by a fourth displacement control mechanism connected to the first displacement control mechanism, whereby the coating clearance, transfer clearance and receiving clearance are made adjustable each independently and, to avoid a rolling contact of the coating roller with the mandrel entering the coating zone, only the coating clearance is expanded while leaving the transfer and receiving clearances, intact without causing any change.

Thus, the first and the second bearing holder use the same pivot shaft in common, so that the structure of the adjusting apparatus in question can be made compact. Furthermore, even when the coating roller is brought away from the mandrel entering the coating zone to its engagement with the latter, the transfer clearance and the receiving clearance are held at the initially set values, therefore the amount of a coating solution transferred and the parallelism between rollers are not affected at all, and so when the coating roller displaces itself back through the present coating clearance for rolling contact with the outer peripheral surface of a cylindrical article fitted over the mandrel entering the coating zone, it is guranteed that a coating film of the same uniform quality as before is formed on the outer peripheral surface of the cylindrical article.

An embodiment of the apparatus of this invention is described below with reference to FIGS. 2 through 5.

The adjusting apparatus, A, of this invention comprises a first displacement control mechanism 36 connected to one end of a first bearing holder 34 the other end of which is pivoted idlably to a fixed pivot shaft 32, the fixed pivot shaft 32 extending horizontally though the upper portion of a stand frame 30; a second displacement control mechanism 44 attached to one side of a second bearing holder 40 which is pivoted idlably to the fixed pivot shaft 32 through the medium of an eccentric bushing 38, the second displacement control mechanism 44 including a connecting screw rod 42 which is connected to the first bearing holder 34; a third displacement control mechanism 50 connected to an eccentric sleeve 48 which bears therethrough a fountain roller shaft 46 in the second bearing holder 40, the fountain roller shaft 46 carrying a fountain roller 24 secured to one end thereof; a transfer roller 22 secured to one end of a transfer roller shaft 52 which is journaled in the second bearing holder 40, the transfer roller 22 being adapted to come into rolling contact with the fountain roller 24 through a receiving clearance C1; a coating roller 20 secured to one end of a coating roller shaft 54 which is rotatably journaled in the first bearing holder 34 at a position close to the other end of the latter, the coating roller 20 being adapted to come into rolling contact with the transfer roller 22 throuh a transfer clearance C2 and also adapted to come into rolling contact through a coating clearance C3 with the outer peripheral surface of a cylindrical article, b, fitted over each mandrel 28 entering a coating zone, z, while being conveyed on an endless-wise travelling mandrel conveyor 26; and a fourth displacement control mechanism 56 having an actuating end connected to the first displacement control mechanism 36 and functioning to exert a collective displacement force on a free end of the first bearing holder 34 with the first displacement control mechanism 36 as a transfer medium, thereby displacing the first bearing holder 34 and the second bearing holder 40 simultaneously and collectively.

Figure 2:
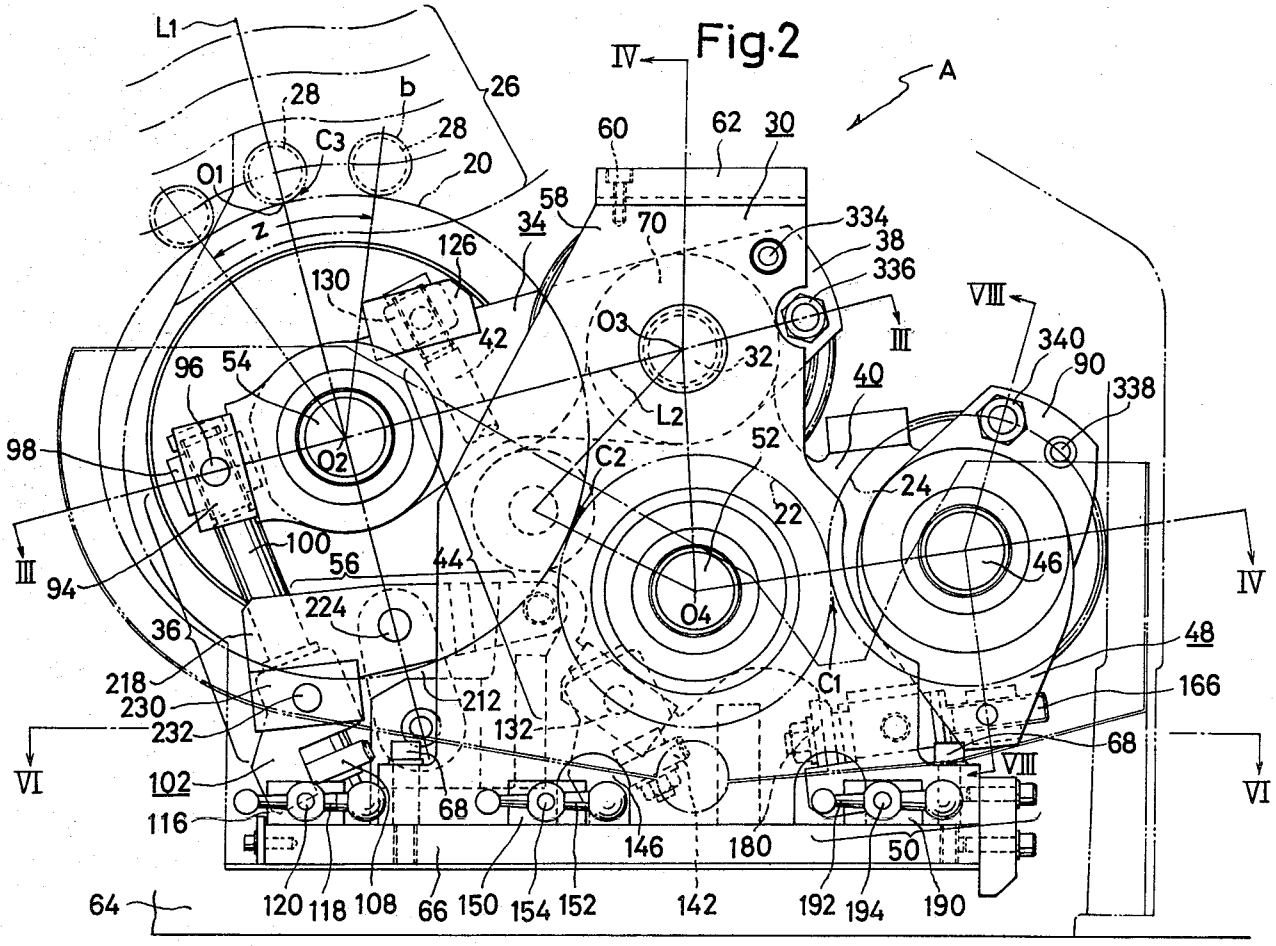
FIG. 2 is a partially omitted side view of an apparatus according to this invention.

The coating roller shaft 54, the fixed pivot shaft 32 and the transfer roller shaft 52 are disposed in such a positional relationship as shown in FIG. 2; that is, the axial center 03 of the fixed pivot shaft 32 is positioned on line L2 which passes through the axial center 02 of the coating roller shaft 54 while intersecting line L1 at right angles, the line L1 passing through the center 01 of the coating zone, z, and the axial center 02 of the coating roller shaft 54, and the axial center 04 of the transfer roller shaft 52 is positioned lower than the axial center 02 of the coating roller shaft 54 and the axial center 03 of the fixed pivot shaft 32 so that the transfer clearance C2 is positioned lower than line L2, further the pivotal displacement of the first bearing holder 34 and that of the second bearing holder 40 are centered on the axial center 03, and the transfer clearance C2 is directed so as not to intersect the mandrel conveyor 26.

The stand frame 30 is gate-shaped consisting of side frames 58,58 on both sides and a ceiling plate 62 extending between the upper ends of the side frames 58, 58, the ceiling plate 62 being fixed with bolt 60 and the side frames 58, 58 being fixed with anchor bolt 68 onto a bed plate 66 so as to be inclination-adjustable in frame 64 of the coating machine.

Figure 3:
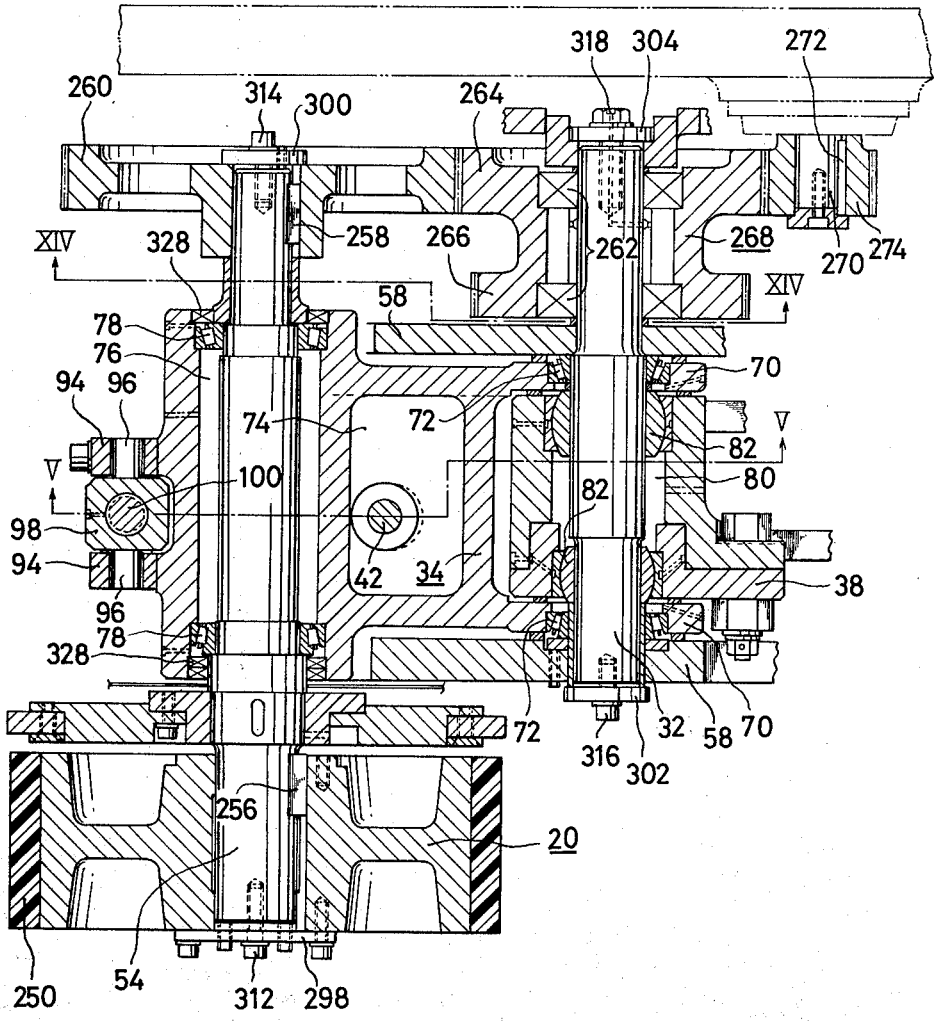
FIGS. 3 and 4 are sectional views respectively taken on line III—III and IV—IV in FIG. 2.
Figure 5:
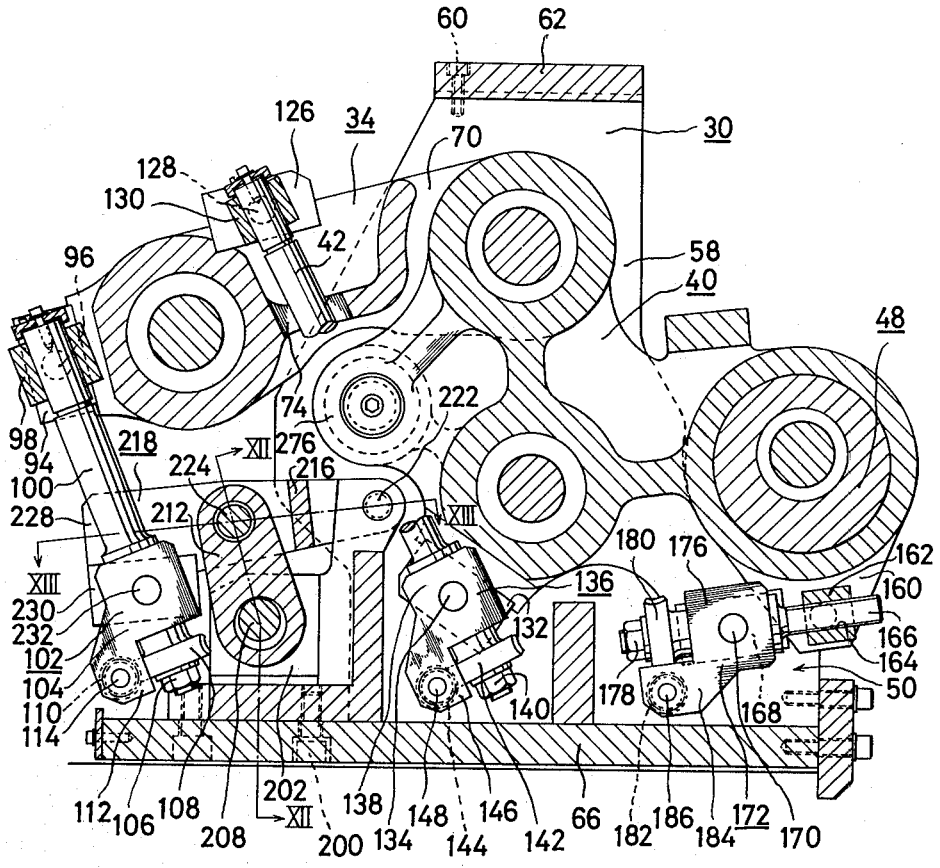
FIG. 5 is a sectional view taken on line V—V in FIGS. 3 and 4.

As shown in FIGS. 2, 3 and 5, the first bearing holder 34 has bifurcated ends 70, 70 which are idlably pivoted between the side frames 58, 58 through the medium of bearings 72, 72 a space portion 74 formed in an intermediate part thereof and further has a transverse shaft hole 76 formed in the vicinity of its free end; in both ends of the transverse shaft hole 76 are fitted bearings 78, 78 in which is rotatably journaled the coating roller shaft 54.

The second bearing holder 40 is pivoted to the fixed pivot shaft 32 between a bearing 82 fitted in one end of a transverse shaft hole 80 and a bearing 82 fitted in the eccentric bushing 38, the transverse shaft hole 80 being formed in the upper portion of the second bearing holder 40 inserted between the bifurcated ends 70, 70 of the first bearing holder 34, while in the lower portion of the second bearing holder 40 are formed transverse shaft holes 84 and 86 and in both ends of the hole 84 are fitted bearings 88, 88 in which is rotatably journaled the transfer roller shaft 52. Pivotably fitted in the transverse shaft hole 86 is the eccentric sleeve 48 in one end of which is pivotably fitted an eccentric bushing 90, and the fountain roller shaft 46 is rotatably journaled in a bearing 92 fitted in the eccentric bushing 90 and in a bearing 92 fitted in the other end of the eccentric sleeve 48.

Figure 9:
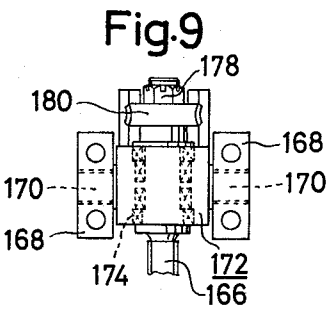
FIGS. 9 through 11 are a plan view, a rear view and a longitudinal sectional view through the center of a connecting bracket portion of the third displacement control mechanism.

The first displacement control mechanism 36 is constructed as illustrated in FIGS. 2, 3, 5 and 6; that is, centrally projected at the free end of the first bearing holder 34 are opposed pieces 94, 94 between which is pivotably mounted a square nut 98 in a crosswise suspended form with side pins 96, 96. With the square nut 98 is threadedly engaged the upper portion of a screw rod 100, while fitted over the lower portion of the screw rod 100 is a square bearing portion 104 of a L-shaped connecting bracket 102 of the same structure as that shown in FIGS. 9 and 11. To the lower end of the screw rod 100 is fixed a worm wheel 108 with nut 106 and a worm 110 in mesh with the worm wheel 108 is fixed to a worm shaft 114 which is rotatably journaled in and through a bifurcated portion 112 of the connecting bracket 102. On the other hand, a bearing block 116 is fixed to a corner on one side end of the bed plate 66 and it bears therethrough an operating handle 118 rotatably, which operating handle 118 has a handle shaft 120 with a projecting end thereof being connected to a projecting end of the worm shaft 114 by means of a connecting rod 124 provided at both ends thereof with universal joints 122, 122.

Figure 6:
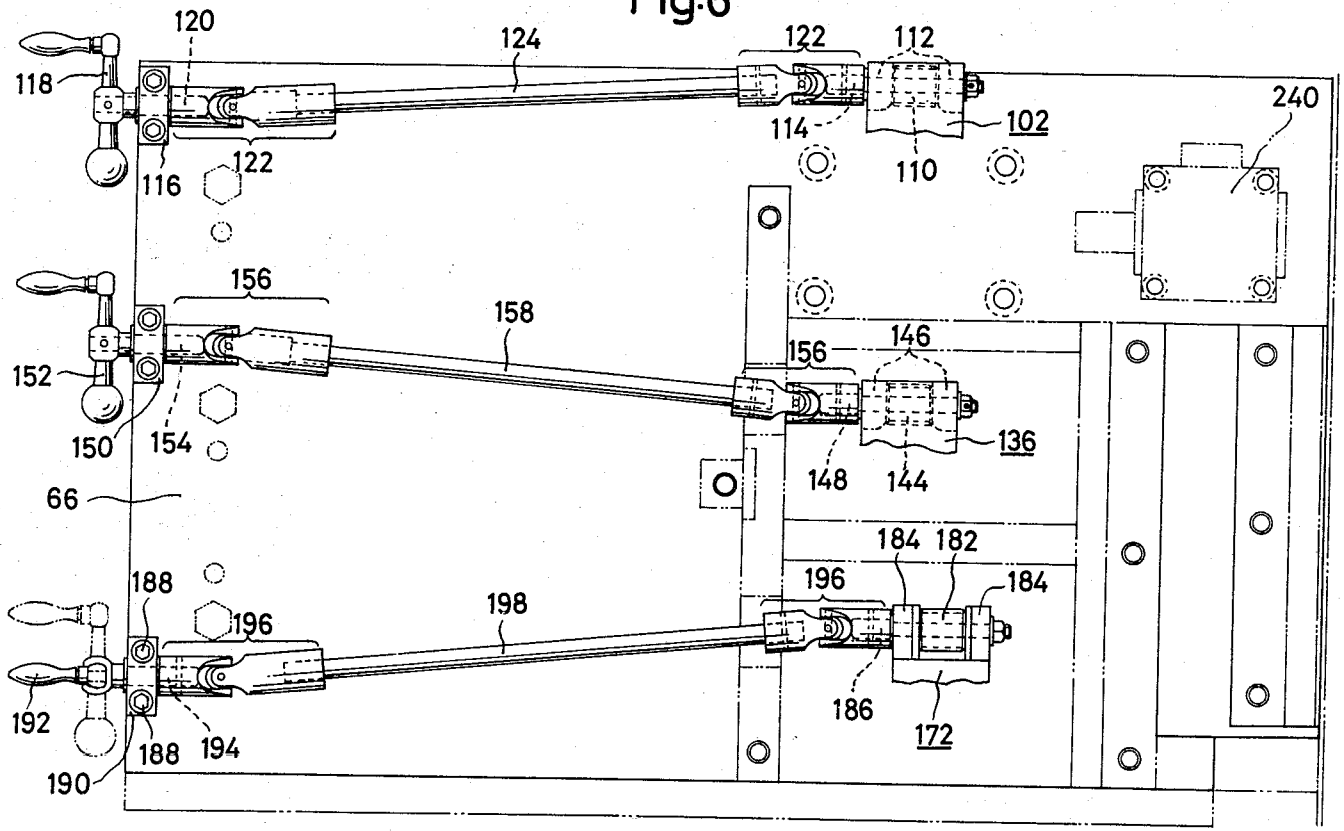
FIG. 6 is a plane arrangement view taken on line VI—VI in FIG. 2 illustrating partially first to third displacement control mechanisms.
Figure 7:
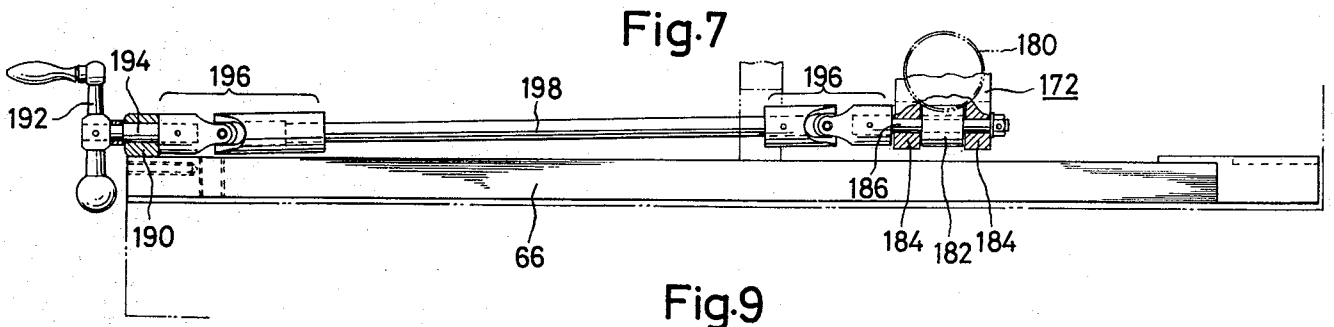
FIG. 7 is a side view of FIG. 6.

The second displacement control mechanism 44 is constructed as illustrated in FIGS. 2, 5 and 6; that is, on both sides of the intermediate portion of the first bearing holder 34 there project opposed pieces 126, 126 between which is pivotably mounted a square nut 130 in a crosswise suspended form with side pins 128, 128. With the square nut 130 is threadedly engaged the upper end portion of a connecting screw rod 42 which is slantwise suspended through the space portion 74 of the first bearing holder 34. On the other hand, at the lower portion of one side of the second bearing holder 40 there project opposed pieces 132, 132 between which is pivotably mounted a square bearing portion 138 of a L-shaped connecting bracket 136 in a crosswise suspended form with side pins 134, 134, the L-shaped connecting bracket 136 being of the same structure as that shown in FIGS. 9 and 11. The lower portion of the connecting screw rod 42 extends through the square bearing portion 138, and to the lower end thereof is fixed a worm wheel 142 with nut 140, while a worm 144 in mesh with the worm wheel 142 is fixed to a worm shaft 148 which is rotatably journaled in and through bifurcated portions 146, 146 of the connecting bracket 136. And a bearing block 150 is fixed to the central portion on the one side end of the bed plate 66 and it bears therethrough an operating handle 152 rotatably, which operating handle 152 has a handle shaft 154 with a projecting end thereof being connected to a projecting end of the worm shaft 148 by means of a connecting rod 158 provided at both ends thereof with universal joints 156, 156.

Figure 11:
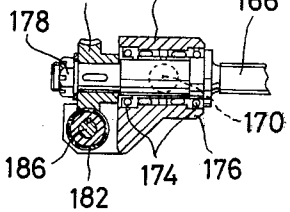
Figure 10:
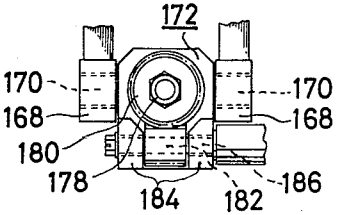
Figure 8:
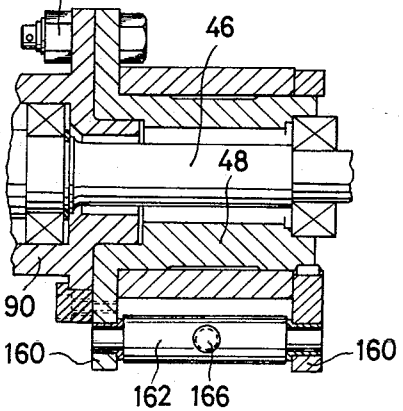
FIG. 8 is a sectional view taken on line VIII—VIII in FIG. 2.
Figure 12:
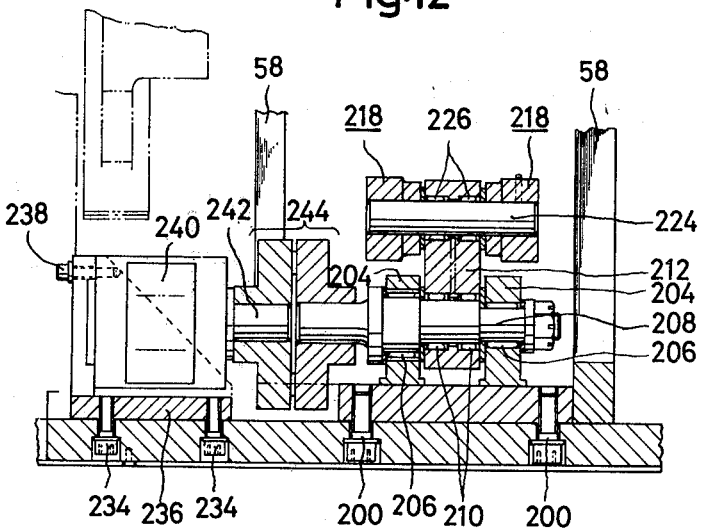
FIGS. 12 and 13 are sectional views respectively taken on lines XII—XII and XIII—XIII in FIG. 5.
Figure 13:
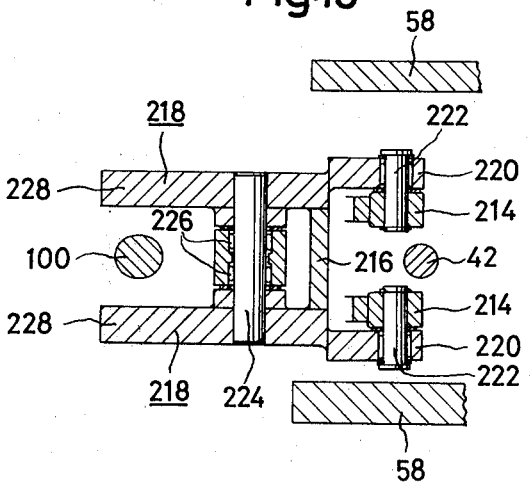

The third displacement control mechanism 50 is constructed as illustrated in FIGS. 2, 5 and 11; that is, opposed arm portions 160, 160 project on the lower side of the outer periphery at both ends of the eccentric sleeve 48, and a square shaft 162 is rotatably journaled at both ends thereof in and through the opposed arm portions 160, 160. The square shaft 162 is provided centrally with an internally threaded hole 164 through which is threadedly engaged the tip end of the screw rod 166, while on a bifurcated lower portion near the other side of the second bearing holder 40 there project opposed pieces 168, 168 between which is inserted a square bearing portion 176 of a L-shaped connecting bracket 172 which is pivotably mounted therebetween in a crosswise suspended form with side pins 170, 170, the square bearing portion 176 has a thrust bearing 174 fitted therein. On the other hand, a worm wheel 180 is secured to the lower end of the screw rod 166 with nut 178, and a worm 182 meshing with the worm wheel 180 is secured to a worm shaft 186 which extends between and is rotatably journaled in a bifurcated portion 184 of the connecting bracket 172, while a bearing block 190 is fixed with bolt 188 in the vicinity of the other corner on the one side end of the bed plate 66 and it bears therethrough an operating handle 192 rotatably, the operating handle 192 having a handle shaft 194 a projecting end of which is connected to a projecting end of the worm shaft 186 by means of a connecting rod 198 provided at both ends thereof with universal joints 196, 196.

The fourth displacement control mechanism 56 is constructed as illustrated in FIGS. 2, 5, 7, 12 and 13; that is, a supporting member 202 is fixed with bolt 200 onto the bed plate 66 below the first bearing holder 34, the supporting member 202 having opposed side walls 204, 204 in which are fitted bearings 206, 206 in opposed manner which bear therethrough an eccentric shaft 208. To the eccentric shaft 208 between the side walls 204, 204 is pivoted the lower end of a link 212 through the medium of a bearing 210, while to the outsides of projecting ends 214, 214 above the side walls 204, 204 are pivoted parallel supporting ends 220, 220 of parallel levers 218, 218 with fulcrum pins 222, 222, the parallel levers 218, 218 being connected integrally with each other by means of a connecting member 216. Extending between and through intermediate portions of the parallel levers 218, 218 is a rib shaft 224 fixed at both ends, to which is pivoted through the medium of a bearing 226 the upper end of the link 212. The parallel levers 218, 218 have actuating ends 228, 228 on the lower side of which there project opposed pieces 230, 230 between which is pivoted the connecting bracket 102 of the first displacement control mechanism 36 in a crosswise suspended form with side pins 232, 232. Furthermore, a seat member 236 is fixed with bolt 234 onto the bed plate 66 adjacent to the supporting member 202. Onto the seat member 236 is seated and fixed a rotary actuator 240 with fixing bolt 238, and a rotary shaft 242 of the rotary actuator 240 and a projecting end of the eccentric shaft 208 are coupled together with coupling 244 for transmission of torque.

Figure 4:
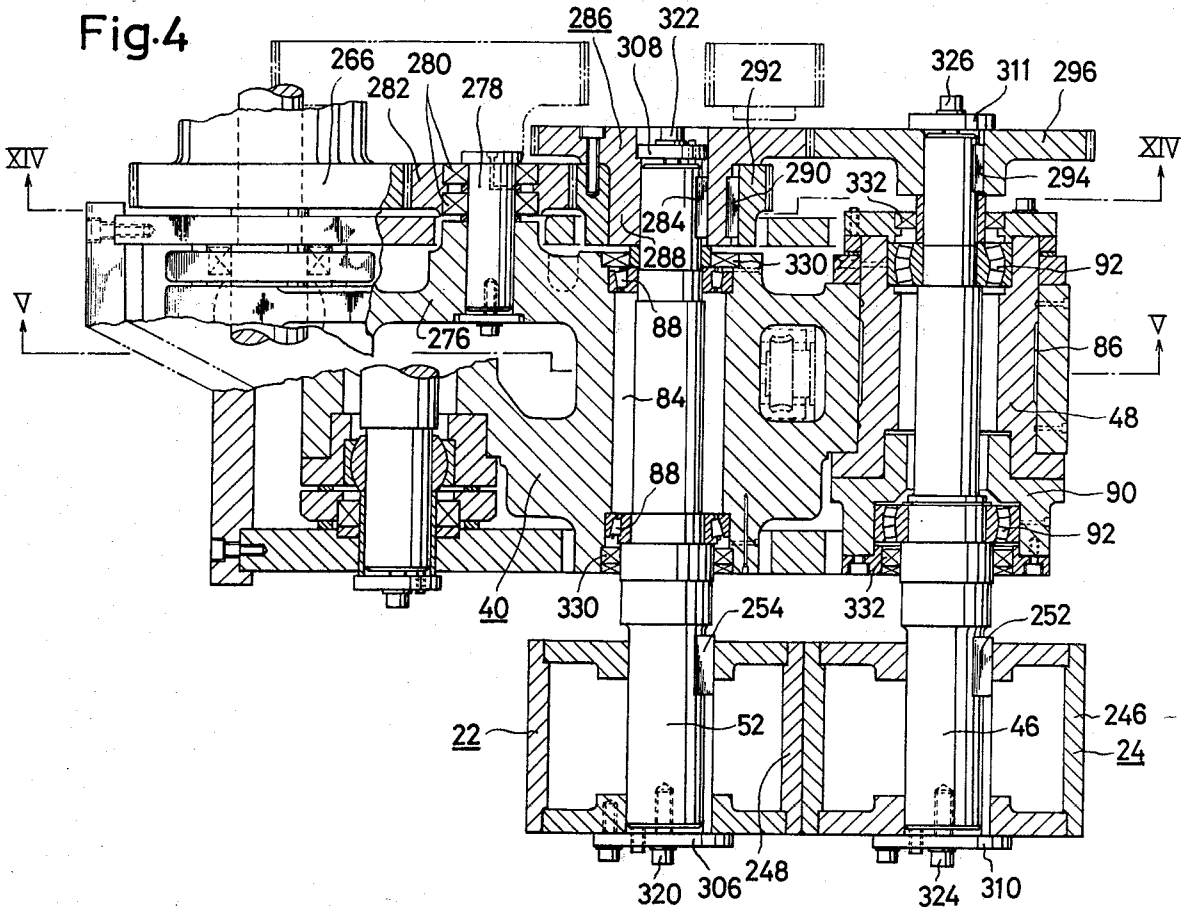
Figure 14:
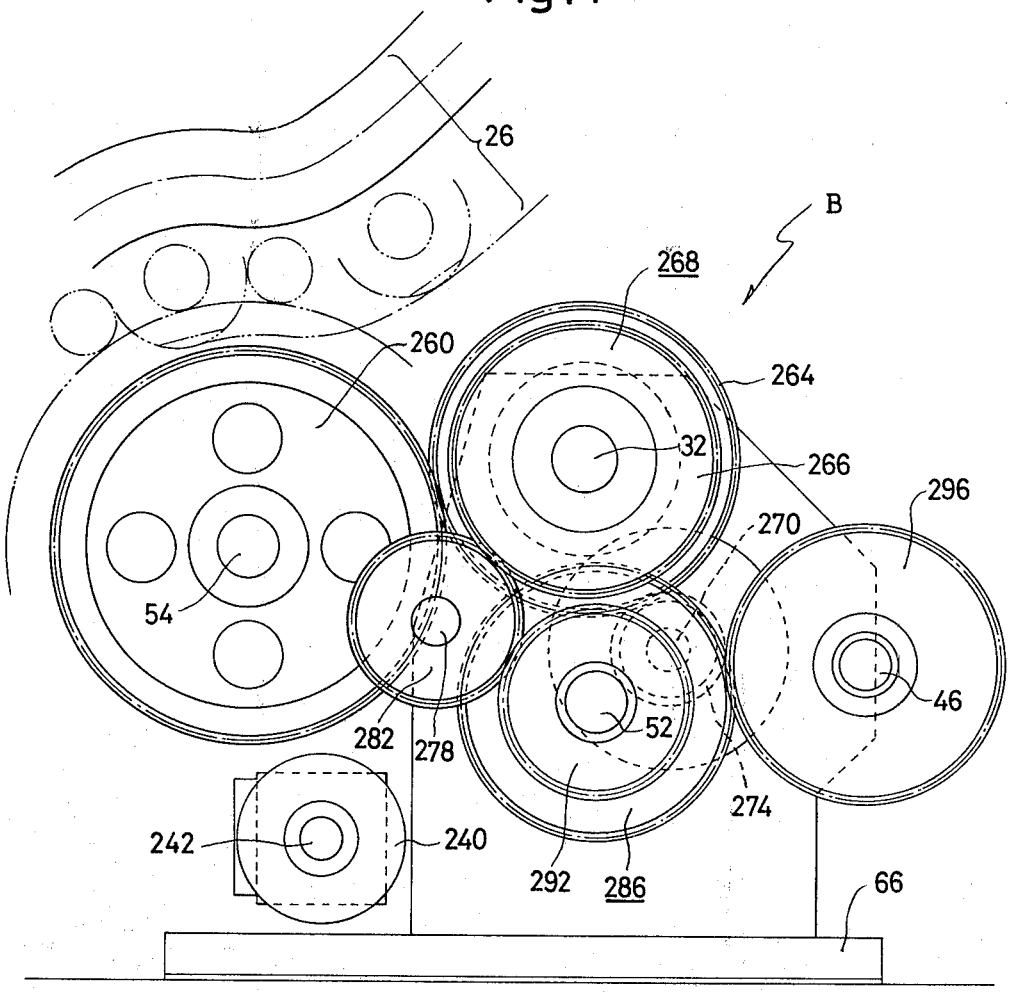
FIG. 14 is a view taken on line XIV—XIV in FIGS. 3 and 4 of a drive transfer mechanism.

The fountain roller shaft 46, the transfer roller shaft 52 and the coating roller shaft 54 which carry on one ends thereof the fountain roller 24, the transfer roller 22 and the coating roller 20 respectively with wedges 252, 254 and 256, are synchronously rotated by means of a drive transmission mechanism, B, the fountain roller 24 being adapted to wind up and stick a coating solution from a coating pan (not shown) onto a metallic outer peripheral surface 246 thereof as it rotates, the transfer roller 22 in rolling contact with the fountain roller 24 through the receiving clearance C1 being adapted to receive the coating solution onto a metallic outer peripheral surface 248 thereof, and the coating roller 20 in rolling contact with the transfer roller 22 through the transfer clearance C2 being adapted to transfer the coating solution onto an outer peripheral rubber surface 250 thereof and to come into rolling contact through the coating clearance C3 with the outer peripheral surface of the cylindrical article, b, fitted over each mandrel 28 entering the coating zone, z, while being carried on the separately endlesswise travelling mandrel conveyor 26, thereby applying the coating solution to the said outer peripheral surface of the cylindrical article, b. The drive transmission mechanism, B, just referred to above is constructed as illustrated in FIGS. 3, 4 and 14; that is, it comprises a gear train consisting of a driven gear 260 secured with wedge 258 to the other end of the coating roller shaft 54, a composite twin gear 268 composed of gears 264, 266 mounted idlably on the other end of the pivot shaft 32 through the medium of bearings 262, 262, a driving gear 274 secured with wedge 272 to an end of an output shaft 270 of a reduction gear (not shown), a relay gear 282 mounted idlably on an end of a counter shaft 278 through the medium of a bearing 280, the counter shaft 278 being fixed to and through in an outwardly overhung manner one side of bifurcated portions 276, 276 on one side of the second bearing holder 40, a driven gear 286 secured with wedge 284 to the other end of the transfer roller shaft 52, a connection gear 292 secured with wedge 290 to a boss portion 288 of the driven gear 286, and a driven gear 296 secured with wedge 294 to the other end of the fountain roller shaft 46. The rotational torque is transmitted successively through outer gearing between the driving gear 274 and the gear 264 of the composite twin gear 268, between the gear 264 of the composite twin gear 268 and the driven gear 260, between the gear 266 of the composite twin gear 268 and the relay gear 282, between the relay gear 282 and the connection gear 292, and between the driven gears 286 and 296.

In FIGS. 3 and 4, the reference numerals 298, 300, 302, 304, 306, 308, 310 and 311 are end plates for sealing shaft ends with bolts 312, 314, 316, 318, 320, 322, 324 and 326, respectively, and the numerals 328, 330 and 332 are sealing rings.

In the apparatus of this invention constructed as above, the coating clearance C3 of the coating roller 20 in rolling contact with the cylindrical matter, b, fitted over each mandrel 28 on the mandrel conveyor 26 entering the coating zone, z, is adjusted in the following manner. By rotating the operating handle 118 of the first displacement control mechanism 36, the worm 110 is rotated integrally with the worm shaft 114 via the connecting rod 124 and the screw rod 100 is threadedly moved integrally with the worm wheel 108 which is in mesh with the worm 110, so that the square nut 98 in threaded engagement with the screw rod 100 moves up or down and the first bearing holder 34 thereby undergoes a slight pivotal displacement integrally with the axial center 03 of the fixed pivot shaft 32 as the center to adjust the rolling contact pressure of the coating clearance C3 whereby the thickness of the film formed on the outer peripheral surface of the cylindrical article, b, can be controlled.

To adjust the transfer clearance C2 between the coating roller 20 and the transfer roller 22, the operating handle 152 of the second displacement control mechanism 44 is rotated to allow the worm 144 to be rotated integrally with the worm shaft 148 via the connecting rod 158, thereby threadedly moving the connecting screw rod 42 integrally with the worm wheel 142 which meshes with the worm 144. As the connecting screw rod 42, restricted at the upper end thereof with the square nut 130 in threaded engagement therewith, moves up or down, the second bearing holder 40 undergoes a slight pivotal displacement integrally with the axial center 03 of the fixed pivot shaft 32 as the center to adjust the transfer clearance C2 of the transfer roller 22 with respect to the coating roller 20 whereby the amount of a coating solution to be transferred from the transfer roller 22 to the coating roller 20 can be controlled.

To adjust the parallelism of the transfer roller 22 with respect to the coating roller 20 in the transfer clearance C2, a locking bolt 334 and a locking nut 336 are loosened, then the eccentric bushing 38 is manually pivoted at a required angle in known manner and, with a slight displacement of one end side of the fixed pivot shaft 32, the second bearing holder 40 is integrally moved and adjusted so that the transfer roller 22 via the transfer roller shaft 52 is made parallel to the coating roller 20 in the transfer clearance C2 whereby a uniform transfer amount of coating solution can be ensured throughout the width of the transfer clearance C2.

For adjusting the receiving clearance C1 between the transfer roller 22 and the fountain roller 24, the operating handle 192 in the third displacement control mechanism 50 is rotated to rotate the worm 182 integrally with the worm shaft 186 via the connecting rod 198, which causes a threaded movement of the screw rod 166 integrally with the worm wheel 180 meshing with the worm 182, so that as the square shaft 162 in mesh with the internally threaded hole 164 moves forward or back by threaded engagement with the screw rod 166 the eccentric sleeve 48 is pivotally moved at a required angle to adjust the rolling contact pressure of the receiving clearance C1 whereby the amount of a coating solution to be transferred from the fountain roller 24 to the transfer roller 22 can be controlled.

To adjust the parallelism of the fountain roller 24 with respect to the transfer roller 22 in the receiving clearance C1, a locking bolt 338 and a locking nut 340 are loosened, then the eccentric bushing 90 is manually pivoted at a required angle in known manner and, with a slight displacement of one end side of the fountain roller shaft 46, the fountain roller 24 is made parallel to the transfer roller 22 in the receiving clearance C1 whereby a uniform transfer amount of coating solution can be ensured throughout the width of the receiving clearance C1.

Thus, the coating clearance C3, the transfer clearance C2 and the receiving clearance C1 are set a predetermined values before the coating operation, namely before start of the coating machine. At the end of or during the coating operation, however, in the event the mandrel 28 on the travelling mandrel conveyor 26 should approach the coating zone, z, without carrying thereon the cylindrical article, b, due to some trouble, the coating clearance C3 must be expanded to separate the coating roller 20 from the mandrel 28 and this can be effected in the following manner. A detector (not shown) senses the arrival just before the coating zone, z, of the mandrel 28 without carrying thereon the cylindrical article, b, whereupon the rotary actuator 240 is operated to pivotally move the rotary shaft 242, thereby pivoting the eccentric shaft 208 at a required angle via coupling 244, which causes the link 212 to move downward, so that with fulcrum pins 222, 222 as the center the parallel levers 218, 218 are pivotally displaced in a counterclockwise direction in FIG. 2 and the connecting bracket 102 is also displaced in the counterclockwise direction together with the side pins 232, 232 to exert a collective pivotal displacement force on the free end of the first bearing holder 34 via the screw rod 100 whereby the first bearing holder 34, together with the second bearing holder 40 connected integrally thereto with the connecting screw rod 42, undergoes a collective pivotal displacement in the counterclockwise direction in FIG. 2. As a result, the coating roller shaft 54, the transfer roller shaft 52 and the fountain roller shaft 46 move on concentric arcs with the axial center 03 of the fixed pivot shaft 32 as the center to expand the coating clearance C3 without causing any change in the transfer clearance C2 and receiving clearance C1 whereby the coating roller 20 is moved out of contact with the passing mandrel 28. And when the detector senses the arrival just before the coating zone, z, of the mandrel 28 with the cylindrical article, b, carried thereon, the rotary actuator is reversed to return the parallel levers 218, 218 to the original clockwise position in FIG. 2 via the link 212, so that the first and second bearing holders 34, 40 together undergo a collective pivotal displacement for return to re-form the original coating clearance C3 whereby, without any change in the transfer clearance C2 and the receiving clearance C1 also at the time of return, a coating film of uniform thickness can be formed on the outer peripheral surface of the cylindrical article, b.

Furthermore, the transfer clearance C2 is positioned lower than line L2 connecting the axial center 03 of the fixed pivot shaft 32 with the axial center 02 of the coating roller shaft 54, which allows the transfer clearance C2 to be directed in a largely deviated manner from the mandrel conveyor 26, so that the mandrel conveyor 26 is not stained with scattered droplets of coating solution from the transfer clearance C2 and the coating operation is so much improved in quality.

It is to be understood that this invention is not restricted to the above-described embodiment and that various design modifications may be made within the spirit of the invention.

What we claim is:

1. An adjusting method for a cylindrical article peripheral surface coating machine of the type in which said cylindrical article peripheral surface coating machine includes a fountain means adapted to take up a coating solution, a transfer means in rolling contact with said fountain means through a receiving clearance adapted to receive the coating solution from said fountain means, and a coating means in rolling contact with said transfer means through a transfer clearance adapted to allow the coating solution to be transferred thereonto and also adapted to come into rolling contact through a coating clearance with the outer peripheral surface of a cylindrical article entering a coating zone while being conveyed on a separately travelling means to apply the coating solution to said outer peripheral surface, the adjusting method comprising adjusting and setting as desired said receiving clearance, said transfer clearance and said coating clearance each independently without affecting each other and, when a portion of said travelling means not carrying thereon the cylindrical article has approached said coating zone, subjecting said coating means, said transfer means and said fountain means to a collective displacement integrally to enlarge said coating clearance while leaving said transfer clearance and said receiving clearance intact without causing any change therein, said collective displacement of said coating means, transfer means and fountain means being a pivotal displacement on concentric arcs, and positioning and placing said transfer clearance on the opposite side to said travelling means and below a straight line which connects the center of said coating means with the center of said collective pivotal displacement for not contaminating said travelling means by the coating solution flying off from said transfer clearance, said collective pivotal displacement being effected with its pivotal center placed on a straight line meeting at right angles with a straight line which passes through the center of the coating zone of said travelling means and the center of said coating means.

2. An adjusting apparatus for a cylindrical article peripheral surface coating machine, comprising a first displacement control means connected to one end of a first bearing holder means the other end of which is pivoted idlably to a pivot shaft means, said pivot shaft means extending horizontally through a stand frame and being positioned on a straight line which passes through the center of a coating roller shaft means and meeting at right angles with a straight line which passes through the center of a coating zone of a mandrel conveyor means and the center of said coating roller shaft means; a second displacement control means attached to one side of a second bearing holder means, said second displacement control means including a connecting screw rod means which is connected to said first bearing holder means; a third displacement control means connected to an eccentric sleeve means which bears therethrough a fountain roller shaft means in said second bearing holder means, said fountain roller shaft means carrying a fountain means secured to one end thereof; a transfer means secured to one end of a transfer roller shaft means which is journaled in and through said second bearing holder means, and which is positioned lower than said coating roller shaft means and said pivot shaft means whereby the transfer clearance is positioned lower than the straight line connecting the center of said coating roller shaft means with the center of said pivot shaft, said transfer means being adapted to come into rolling contact with said fountain means through a receiving clearance; a coating means secured to one end of said coating roller shaft means which is rotatably journaled in and through said first bearing holder means at a position close to the other end of the latter, said coating means being adapted to come into rolling contact with said transfer means through said transfer clearance and also adapted to come into rolling contact through a coating clearance with the outer peripheral surface of a cylindrical article fitted over a mandrel entering a coating zone while being conveyed on a separately travelling mandrel conveyor means; and a fourth displacement control means capable of displacing said first and second bearing holders means simultaneously and collectively.

3. The adjusting apparatus for the cylindrical article peripheral surface coating machine as defined in claim 2, in which said second bearing holder means is pivoted to said pivot shaft means through the medium of an eccentric bushing means.

4. The adjusting apparatus for the cylindrical article peripheral surface coating machine as defined in claim 2, in which said fourth displacement control means has an actuating end connected to said first displacement control means to exert a collective displacement force on said first bearing holder means with said first displacement control means as a transmission medium.

* * * * *